US006085356A

United States Patent [19]

Redmond, Sr.

[11] Patent Number: 6,085,356

[45] Date of Patent: Jul. 11, 2000

[54] WAISTXPANDER

[76] Inventor: Craig C. Redmond, Sr., 410 McLand Rd., Mount Holly Springs, Pa. 17065

[21] Appl. No.: 09/396,687

[22] Filed: Sep. 14, 1999

[51] Int. Cl.[7] ..... A41F 9/02

[52] U.S. Cl. ..... 2/237; 2/76; 2/220; 2/236; 2/338

[58] Field of Search ..... 2/76, 141.1, 219–221, 2/235–237, 311–312, 336, 323, 338, 316, 319, 240, 107, 112, 117; 24/322.1, 323, 378.1, 379.1

[56] References Cited

U.S. PATENT DOCUMENTS

| | | | |
|---|---|---|---|
| 4,164,044 | 8/1979 | Holmes | 2/237 |
| 4,578,827 | 4/1986 | Appelt . | |
| 4,580,298 | 4/1986 | Tuisl | 2/237 |
| 4,620,326 | 11/1986 | Matthias | 2/221 |
| 4,803,740 | 2/1989 | Dawson | 2/215 |
| 4,920,581 | 5/1990 | Gray . | |
| 5,023,979 | 6/1991 | Bennett et al. . | |
| 5,313,669 | 5/1994 | Rasdell et al. | 2/323 |
| 5,575,011 | 11/1996 | Allen . | |
| 5,898,947 | 5/1999 | Page | 2/237 |

FOREIGN PATENT DOCUMENTS

| | | |
|---|---|---|
| 854332 | 11/1952 | Germany . |
| 347949 | 12/1937 | Spain . |
| 410210 | 5/1934 | United Kingdom . |
| 810855 | 3/1959 | United Kingdom . |

*Primary Examiner*—John J. Calvert
*Assistant Examiner*—Tejash Patel
*Attorney, Agent, or Firm*—Susan Borden Evans

[57] ABSTRACT

Disclosed herein is a detachable waist band expander for temporarily adjusting the waist band size of a garment. The user attaches the waist band expander to the button and the button slit of their clothing. The present invention includes an optional sized button which is inserted into the button slit of the waist band of the garment as a button hooking device engages the button of the garment. Hook and pile inserts serve as a size adjustment means.

13 Claims, 3 Drawing Sheets

WAISTXPANDER

BACKGROUND

The present invention relates generally to a temporary waist band expander for garments. It is useful regardless of the age, sex or circumference of the user.

This product can be used, for example, by a pregnant woman or a man that had that extra slice of pizza one too many times. It not only is a money saving contrivance, but it helps fill that little void between clothing sizes. The present invention allows users to temporarily adjust the waist size of their clothes at little cost. The present invention does not require any modification of the users clothing which many of the prior art products require. The user attaches the WaistXpander™ to the button and the button slit of their accouterments. The users can then simply slip on a shirt or sweater or any un-tucked top to cover their waistline and WaistXpander™.

Various waist expander mechanisms are known in the art. One such patent discloses a detachable waist band extender with a tab portion which is fastened to a button on a first side of a fly opening of a garment and a traditional belt mechanism which engages the second side of the fly opening. See U.S. Pat. No. 5,575,011 (Todd M. Allen).

This prior art does not disclose the instant invention.

SUMMARY OF THE INVENTION

The present invention provides a detachable waist band expander for temporarily adjusting the waist band size of a garment including:

a rectangular strip of material with an outer side and an inner side, the outer side having a button end and a free end, the inner side having a left half and a right half, with corresponding Velcro® inserts on each of the left and right halves which when folded in half the corresponding Velcro® inserts adhere to each other cooperating as a size adjustment means;

an optional sized button attached to the button end of the outer side; and a button hooking device which is slideably positioned along the length of the rectangular strip of material allowing the ends of the rectangular strip of material to fold on each other thereby allowing the corresponding Velcro® strips to engage one another and serve as a size adjustment means.

The present invention also provides for a waist band expanded garment including:

A garment having a waist band wherein the waist band has an opening therein with a button on one side of the opening and a button slit on the other side of the opening such that when the button and button slit are engaged the opening is closed; and A detachable waist band expander for temporarily adjusting the waist band size of a garment comprising a rectangular strip of material with an outer side and an inner side, the outer side having a button end and a free end, the inner side having a left half and a right half, with corresponding Velcro® inserts on each of the left and right halves which when folded in half the corresponding Velcro® inserts adhere to each other cooperating as a size adjustment means; an optional sized button attached to the button end of the outer side for insertion into the button slit of the waist band of the garment; and a button hooking device, for attaching to the button of the garment, which is slideably positioned along the length of the rectangular strip of material allowing the ends of the rectangular strip of material to fold on each other thereby allowing the corresponding Velcro® strips to engage one another and serve as a size adjustment means for the waist band expander.

BRIEF DESCRIPTION OF THE DRAWINGS

These as well as other features of the present invention will become more apparent upon reference to the drawings wherein.

DETAILED DESCRIPTION OF THE INVENTION

Figure 1:
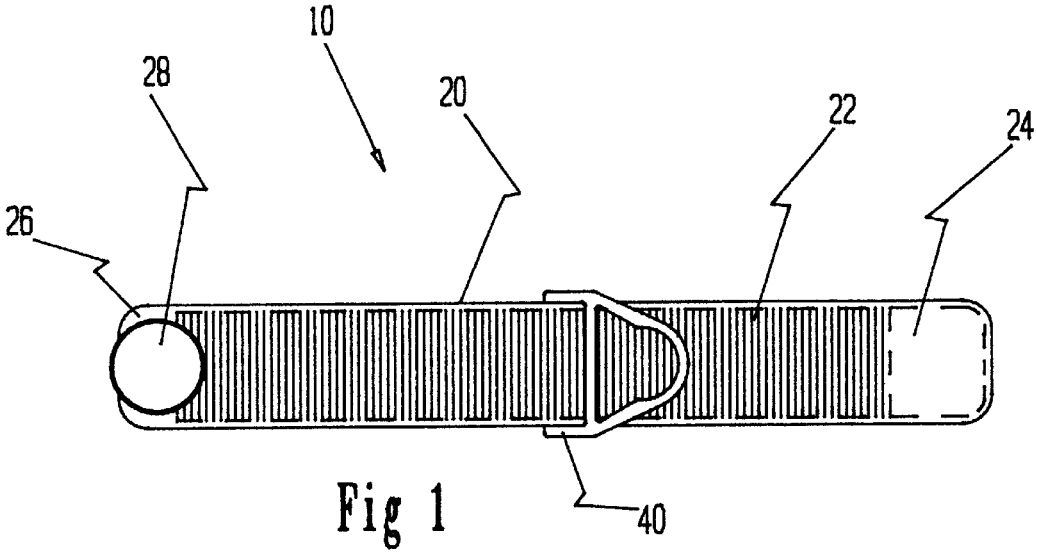
FIG. 1 is a front view of the detachable waist band expander of the present invention with the inclusion of the button hooking device.

FIGS. 1–6 collectively illustrate the components of the detachable waist band expander of the present invention 10. The detachable waist band expander 10 is used to expand the waist band of a garment 50 such as the garments shown in FIGS. 7 and 8. The detachable waist band expander 10 includes a rectangular strip of material 20 with an outer side 22 and an inner side 30, the outer side has a button end 26 and a free end 24, the inner side 30 has a left half 32 and a right half 34, with corresponding Velcro® inserts 36, 38 on each of the left and right halves 32, 34 which when folded in half the Velcro® inserts 36, 38 adhere to each other cooperating as an adjustment means. An optional sized button 28 attached to the button end 26 of the outer side 22. The optional sized button 28 can be sized to fit the dimensions of the button hole opening 54 (also known as the button slit, which terms are herein used interchangeably) of the garment 50. The button 28 may be attached by any of many attachment means well known in the art, including but not limited to a tack 29. A button hooking device 40 which is ideally positioned along the length of the rectangular strip of material 20 allows the ends of the rectangular strip of material 20 to fold on each other thus allowing the corresponding Velcro® inserts 36, 38 to engage one another and serve as a size adjustment means.

The Velcro® inserts permit infinite adjustment settings as there are no preset spaced settings to restrict the size adjustment as taught in the prior art. This allows an increase or decrease in the expansion of the waist size of the garment at the unfettered discretion of the user.

The detachable waist band expander is constructed of a durable elasticized material preferably elastic, rubber and malleable fabric; more preferably elastic. Malleable fabrics are well known in the art and include fabrics such as variable thickness Lycra® Spandex.

FIG. 1 depicts a front view of the present invention with the button hooking device 40 positioned midway along the outstretched waist band expander 10.

Figure 2:
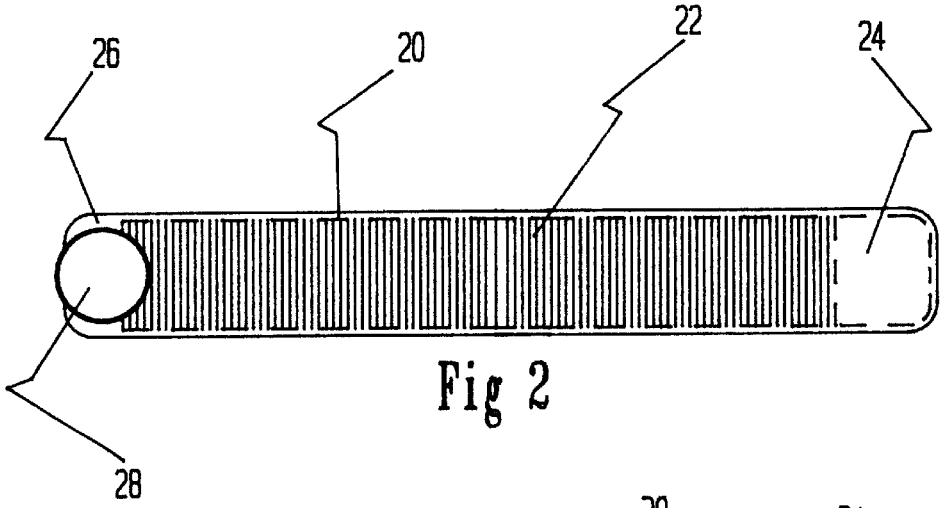
FIG. 2 is a front view of the rectangular strip of material of the detachable waist band expander of the present invention.

FIG. 2 depicts the outer side 22 of the rectangular strip of material 20 which has an optional sized button 28 at the button end 26 and a free end 24. The ends are optional reinforced with a durable material which is selected from the group consisting of leather, plastic, leather like synthetic, vinyl and suede; preferably vinyl and leather; more preferably vinyl. The rectangular strip of material 20 which forms the body of the detachable waist band expander 10 can be formulated in various lengths and widths (small, medium, large and extra large) fitted to the circumference of the user and the width of the waist band of the garment 50.

Figure 3:
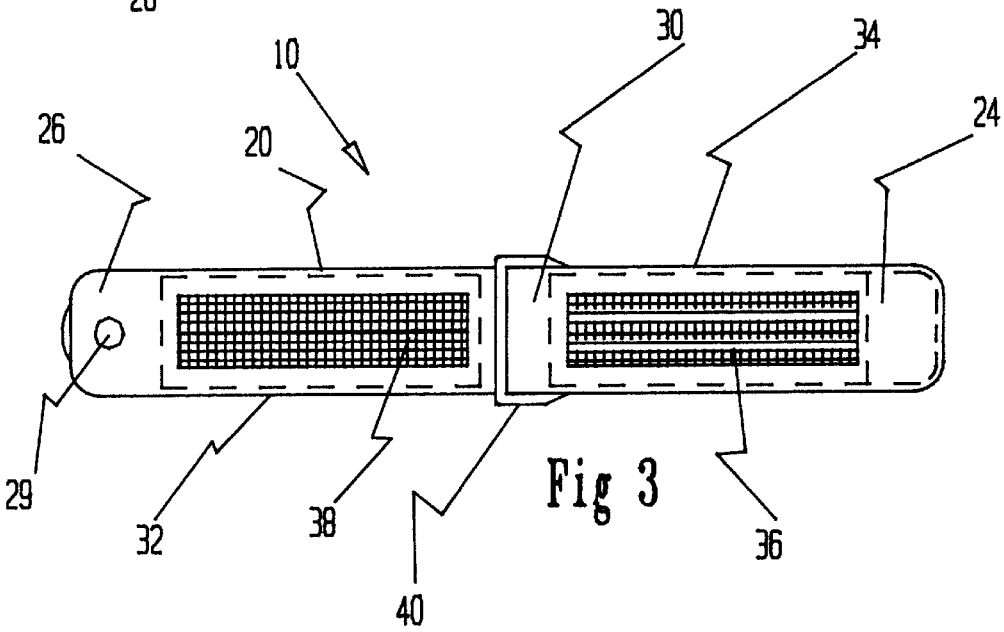
FIG. 3 is a rear view of the rectangular strip of material of the detachable waist band expander of the present invention.

FIG. 3 depicts the inner side 30 of the rectangular strip of material 20 which has a left half 32 and a right half 34 with corresponding Velcro® or Velcro®-like fabric inserts 36, 38 on each of the right and left halves. The rectangular strip of material 20 when folded allows the strips of Velcro® or Velcro®-like fabric on the two halves to adhere one to the other thus cooperating as an adjustment means. The Velcro® inserts consist of corresponding hook and pile type Velcro® which allows the corresponding forms of Velcro® to fasten one to the other. The use of the corresponding forms of Velcro® also allows for the quick release in the adjustment or removal of the waist expander of the instant invention. The use of Velcro® and Velcro®-like materials is well known in the art.

Figure 4:
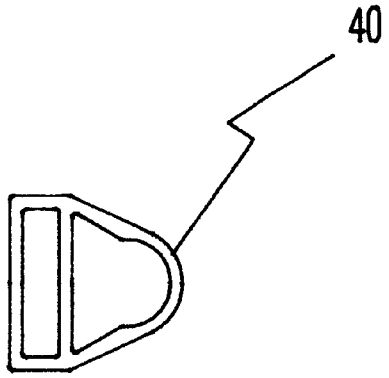
FIG. 4 is a front view of the of the button hooking device of the present invention.

FIG. 4 depicts a button hooking device 40 which is slideably positioned along the length of the rectangular strip of material 20. The button hooking device 40 of the present invention slides onto the rectangular strip of material 20 at the free end 24. The button hooking device 40 allows the ends of the rectangular strip of material 20 to fold on each other thereby allowing the corresponding Velcro® inserts 36, 38 to engage one another and serve as a size adjustment means. Button hooking devices are well known in the art and can be made of any number of materials selected from the group consisting of plastic, formed steel, stainless steel and brass; preferably plastic and stainless steel; more preferably plastic. The open end of the button hooking device is formed to fit around the button of the garment being worn as in FIGS. 7 and 8. An example of a plastic button hooking device 40 is a plastic injected molded buckle(slotted triangle #PLST 110) from Albest Company.

Figure 5:
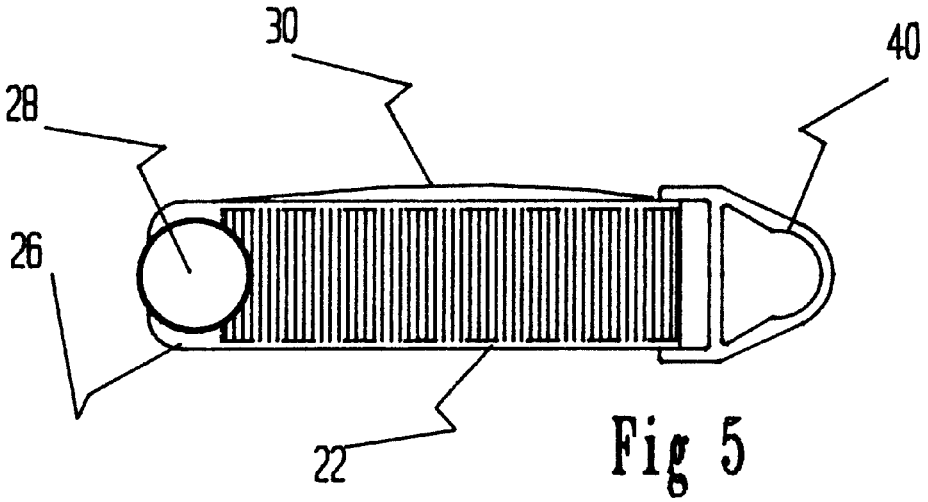
FIG. 5 is a top view of the outer side of the present invention folded in half with the Velcro® inserts engaging one another and adjusted for minimum expansion.
Figure 6:
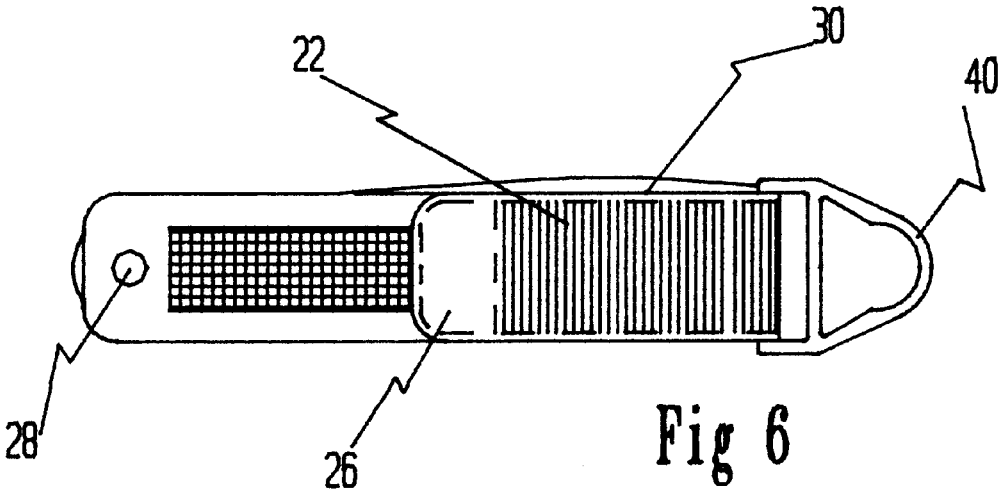
FIG. 6 is a is a top view of the inner side of the present invention folded in half with the Velcro® inserts engaging one another and adjusted for maximum expansion.
Figure 7:
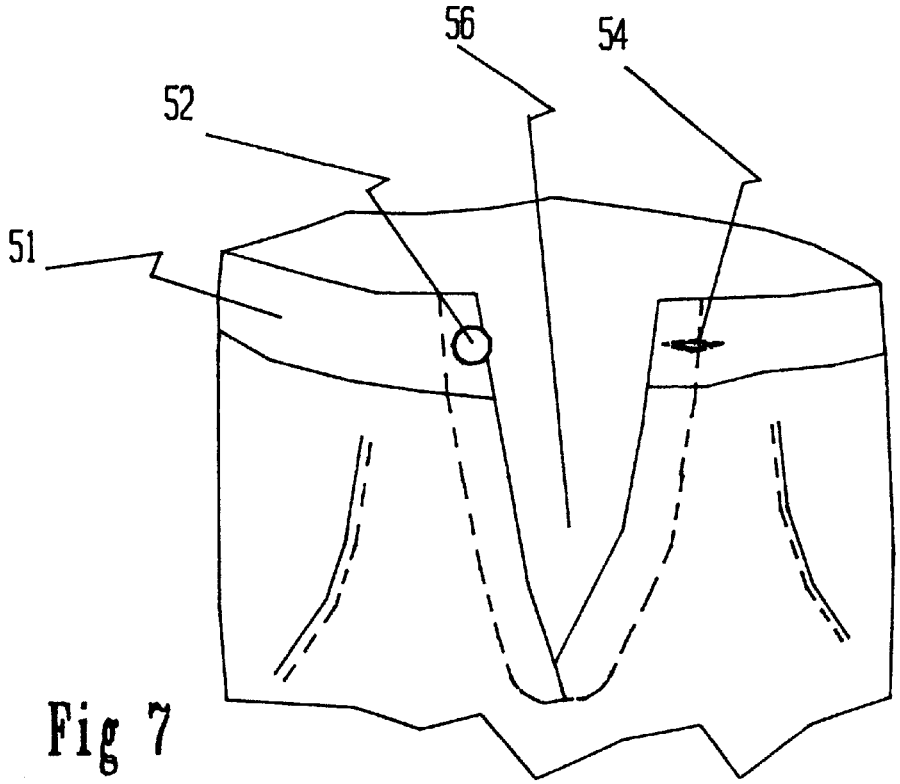
FIG. 7 is a partial perspective view of a garment with a waist band having an opening therein with which the detachable waist band expander of the present invention is to be used.

FIGS. 5 and 6 depict the waist band expander 10 of the present invention in folded positions, showing a minimum adjustment in FIG. 5 and a maximum adjustment in FIG. 6.

Figure 8:
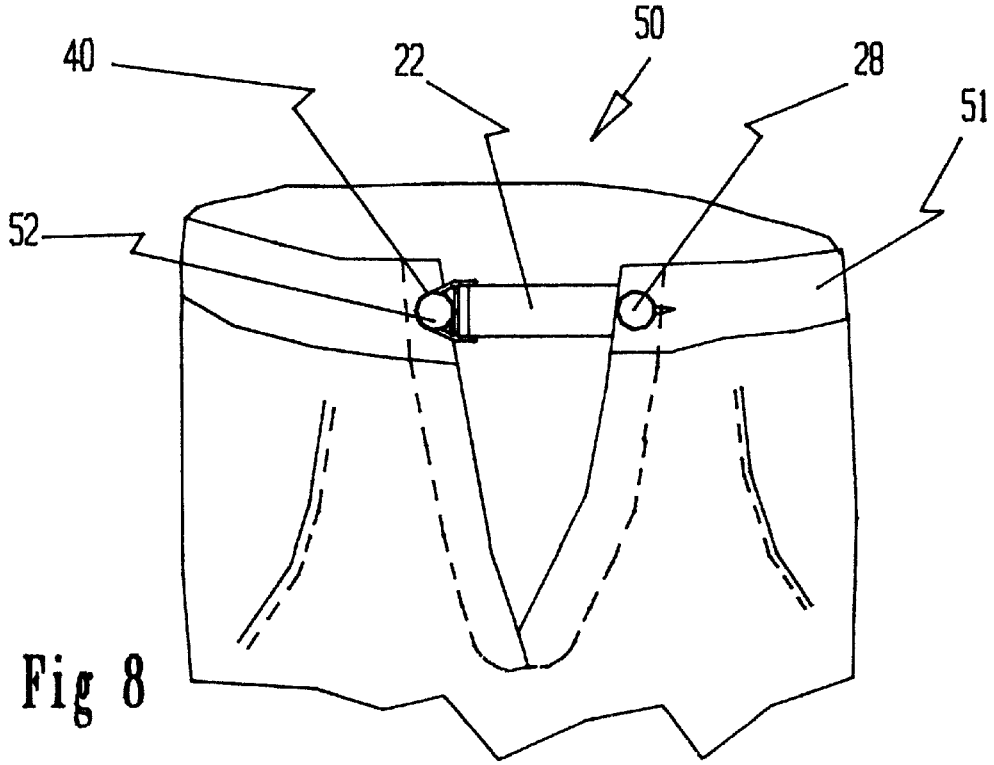
FIG. 8 is a partial perspective view of a garment with a waist band with the detachable waist band expander fully attached.

FIG. 8 depicts a waist band expanded garment 50. The waist band expanded garment 50 has a waist band 51 with an opening 56 therein. There is a button 52 on one side of the garment opening and a button slit 54 on the other side of the garment opening 56 such that when the garment button 52 and garment button slit 54 are engaged the opening 56 is closed. The garment 50 is associated with the detachable waist band expander 10 of the present invention which allows for temporarily adjusting the waist band size of said garment 50. The optional sized button 28 which is attached to the outer side 22 of the rectangular strip of material 20 is inserted into the button slit 54 of the waist band of the garment 50 and the button hooking device 40 is attached to the button 52 of the garment to allow the waist band to be expanded. The waist band expander 10 is thereafter adjusted by increasing or decreasing the fold of and permitting the corresponding Velcro® inserts 36, 38 to engage one another and serve as a size adjustment means.

Changes and modifications in the specifically described embodiments can be carried out without departing from the scope of the invention which is intended to be limited only by the scope of the appended claims.

What is claimed is:

1. A detachable waist band expander for temporarily adjusting the waist band size of a garment comprising:

a rectangular strip of material with an outer side and an inner side, the outer side having a button end and a free end, the inner side having a left end and a right end, with corresponding hook and pile inserts on each of the left and right halves which when folded in half the corresponding hook and pile inserts adhere to each other cooperating as a size adjustment means;

a sized button attached to the button end of the outer side; and a slidable button hooking means positioned along the length of the rectangular strip of material for allowing the ends of the rectangular strip of material to fold on each other and allowing the corresponding hook and pile strips to engage one another and serve as a size adjustment means.

2. The detachable waist band expander according to claim 1 wherein the rectangular strip of material is a durable elasticized material selected from the group consisting of elastic, rubber and malleable fabric.

3. The detachable waist band expander according to claim 2 wherein the rectangular strip of material consists of an elasticized fabric.

4. The detachable waist band expander according to claim 3 wherein the ends are reinforced with a durable material wherein the durable material is selected from the group consisting of leather, plastic, a leather like synthetic, vinyl and suede.

5. The detachable waist band expander according to claim 4 wherein the ends are reinforced with a durable material wherein the durable material is vinyl.

6. The detachable waist band expander according to claim 5 wherein the button hooking device is made of a sturdy material selected from the group consisting of plastic, formed metal, stainless steel and brass.

7. The detachable waist band expander according to claim 6 wherein the button hooking device is made of plastic.

8. The detachable waist band expander according to claim 7 wherein the length of the rectangular strip of material is selected from the group consisting of sizes characterized as small, medium, large and extra large.

9. The detachable waist band expander according to claim 8 wherein the optional sized button is selected from the group consisting of sizes characterized as small, medium, large and extra large.

10. A waist band expanded garment comprising:

A garment having a waist band wherein the waist band has an opening therein with a button on one side of the opening and a button slit on the other side of the opening such that when the button and button slit are engaged the opening is closed; and A detachable waist band expander for temporarily adjusting the waist band size of a garment comprising a rectangular strip of material with an outer side and an inner side, the outer side having a button end and a free end, the inner side having a left end and a right end, with corresponding hook and pile inserts on each of the left and right halves which when folded in half the corresponding hook and pile inserts adhere to each other cooperating as a size adjustment means; a sized button attached to the button end of the outer side for insertion into the button slit of the waist band of the garment; and a slideable button hooking means, for attaching to the button of the garment, which is positionable along the length of the rectangular strip of material and for allowing the ends of the rectangular strip of material to fold on each other thereby an allowing the corresponding hook and pile strips to engage one another and serve as a size adjustment means.

11. The waist band expanded garment of claim 10, wherein the detachable waist band expander is made of an elasticized material.

12. The waist band expanded garment of claim 11, wherein the button hooking device is made of a sturdy material selected from the group consisting of plastic, formed metal, stainless steel and brass.

13. The waist band expanded garment of claim 12, wherein the button hooking device is a plastic hook device.

* * * * *